US008207462B2

(12) United States Patent
Tsai

(10) Patent No.: US 8,207,462 B2
(45) Date of Patent: Jun. 26, 2012

(54) KEY STRUCTURE HAVING IMPROVED LIGHT EMITTING EFFICIENCY

(75) Inventor: Chung-Lin Tsai, Chung-Li (TW)

(73) Assignee: Global Lighting Technologies (Taiwan) Inc., Chung-Li (TW)

( * ) Notice: Subject to any disclaimer, the term of this patent is extended or adjusted under 35 U.S.C. 154(b) by 539 days.

(21) Appl. No.: 12/551,565

(22) Filed: Sep. 1, 2009

(65) Prior Publication Data

US 2011/0050464 A1 Mar. 3, 2011

(51) Int. Cl.
*H01H 9/00* (2006.01)

(52) U.S. Cl. ..... 200/310; 200/313; 200/314; 200/319; 341/20; 341/23; 400/472; 400/490

(58) Field of Classification Search ..... 341/20–23; 200/310, 313, 314, 319; 400/472, 490
See application file for complete search history.

(56) References Cited

U.S. PATENT DOCUMENTS

| | | | | |
|---|---|---|---|---|
| 6,040,822 | A * | 3/2000 | Decker | 345/168 |
| 7,057,125 | B1 * | 6/2006 | Tsai | 200/310 |
| 7,283,066 | B2 * | 10/2007 | Shipman | 341/22 |
| 7,345,250 | B2 * | 3/2008 | Hakunti et al. | 200/5 A |
| 7,608,792 | B1 * | 10/2009 | Tsai | 200/310 |
| 7,939,773 | B2 * | 5/2011 | Tsai | 200/313 |
| 8,097,822 | B2 * | 1/2012 | Lee et al. | 200/314 |
| 2009/0067153 | A1 * | 3/2009 | Takeda et al. | 362/85 |
| 2010/0148994 | A1 * | 6/2010 | Lin | 341/22 |
| 2010/0187078 | A1 * | 7/2010 | Bai | 200/314 |
| 2010/0188269 | A1 * | 7/2010 | Lin et al. | 341/22 |
| 2010/0328108 | A1 * | 12/2010 | Lee et al. | 341/22 |
| 2012/0070218 | A1 * | 3/2012 | Cheng et al. | 400/472 |

FOREIGN PATENT DOCUMENTS

TW 509955 11/2002

* cited by examiner

*Primary Examiner* — Linh Nguyen
(74) *Attorney, Agent, or Firm* — Lin & Associates IP, Inc.

(57) ABSTRACT

A key structure having an improved light emitting efficiency is provided. The key structure includes a light guide plate, an isolation sheet, a circuit board, an elastic member, and a key cap sequentially disposed one on another in order. A circuit and a plurality of first electrical contacts are distributed on a top surface of the light guide plate. An optical structure is disposed at a bottom surface of the light guide plate. The isolation sheet has a light reflective surface facing the light guide plate. A light source emits a light into the light guide plate. The light is reflected by the optical structure to pass through the through holes configured at the isolation sheet, thus allowing more light outputting through the through holes, so as to improve the illumination of the key cap, and improve the light emitting efficiency.

8 Claims, 3 Drawing Sheets

KEY STRUCTURE HAVING IMPROVED LIGHT EMITTING EFFICIENCY

BACKGROUND OF THE INVENTION

1. Field of the Invention

The present invention relates generally to a key structure having an optical visual effect, and more particularly, to a key structure having an improved light emitting efficiency.

2. The Prior Arts

Early laptop computers and desktop computers are usually equipped with keyboards which are incapable of emitting light. Recently, according to the progress made with respect to the backlight module technology, light emitting apparatuses have been provided to conventional keyboards by some of the keyboard manufacturers, for providing illumination to the keyboards or for ornament purpose.

Taiwanese patent publication No. 509955 discloses a light emitting keyboard. The light emitting keyboard is featured in that it includes a key portion and a backlight device. The key portion includes a bottom plate and at least one key disposed on the bottom plate. The key is adapted for upwardly and downwardly moving relative to the bottom plate. The backlight device is disposed beneath the key portion for providing a light source for the key portion from the underside of the key portion. The light source provides a light upwardly passing through the key portion so as to provide a light emitting effect to the keyboard. In addition to an object of providing the light emitting effect to the keyboard, Taiwanese patent application publication No. 509955 further concerns to configure the light emitting keyboard with a smaller thickness. However, when considered to be employed in electronic products requiring for a higher rank of portability and slimness, the keyboard proposed by Taiwanese patent application publication No. 509955 is not good enough.

A typical conventional slim keyboard generally includes a light guide plate, an isolation sheet, a light transmissive circuit board, an elastic member, and a light transmissive key cap sequentially disposed one on another in order. The light guide plate includes a circuit board and a plurality of first electrical contacts distributed thereon. The circuit board further includes a plurality of second electrical contacts positionally corresponding to the first electrical contacts. The isolation sheet is configured with a plurality of through holes positionally corresponding to the first electrical contacts and the second electrical contacts. A light source is provided at a lateral side of the light guide plate, and inputs a light inside the circuit board. The light is then reflected by optical structures provided at a bottom of the light guide plate and passes through the through holes for outputting, so that the key cap achieves an optical visual effect. Regarding the conventional light emitting keyboard structure, the light emitting efficiency cannot be improved while remaining the volume and thickness of the backlight module, unless more or brighter light sources are used.

SUMMARY OF THE INVENTION

A primary objective of the present invention is to provide a key structure having an improved light emitting efficiency without increasing the volume and thickness of the backlight module.

According to an embodiment of the present invention, the present invention is featured in that it employs a light reflective sheet serving as an isolation sheet disposed between the light guide plate and the circuit board. The isolation sheet is configured with a plurality of through holes positionally corresponding to the keys. As such, when the light is inputted into the light guide plate, a part of the light is allowed to directly output from the through holes, and another part of the light is reflected by the isolation sheet to the light guide plate, and is then reflected by the optical structures disposed at the bottom of the light guide plate so as to pass the through holes and finally reach the key caps. In such a way, the key caps are provided with an improved illumination, thus improving the light emitting efficiency.

The present invention provides a key structure. The key structure includes a light guide plate, an isolation sheet, a circuit board, an elastic member, and a key cap sequentially disposed one on another in order. A circuit and a plurality of first electrical contacts are distributed on a top surface of the light guide plate. An optical structure is disposed at a bottom surface of the light guide plate. A light source is provided at a lateral side of the light guide plate. The isolation sheet is configured with a plurality of through holes positionally corresponding to the first electrical contacts. The circuit board is configured with a plurality of second electrical contacts positionally corresponding to the through holes and the first electrical contacts. The isolation sheet has a light reflective surface positioned facing the light guide plate. The light reflective surface has a plurality of fine protrusion dots, or fine recess dots, or protrusion ribs, or recess slots thereon. The light reflective surface is adapted for reflecting the light outputted from the light guide plate back to the light guide plate. Then, the light is reflected by the optical structure to pass through the through holes, thus allowing more light outputting through the through holes, so as to improve the illumination of the key cap, and improve the light emitting efficiency.

According to an embodiment of the present invention, the isolation sheet is made of a material having optimal light reflective characteristics, and the through holes are formed by previously punching the isolation sheet corresponding to the first electrical contacts and the second electrical contacts.

According to an embodiment of the present invention, the optical structure is a reflective film provided at the bottom surface of the light guide plate. According to an alternative embodiment, the optical structure is composed of a plurality of fine protrusion dots or fine recess dots, which are adapted for reflecting light illuminated thereon.

Comparing with the aforementioned conventional key structure, the key structure of the present invention achieves an improved illumination and light emitting efficiency of the keys without introducing additional components and increasing the volume or thickness of the key structure.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENT

The accompanying drawings are included to provide a further understanding of the invention, and are incorporated in and constitute a part of this specification. The drawings illustrate embodiments of the invention and, together with the description, serve to explain the principles of the invention.

Figure 1:
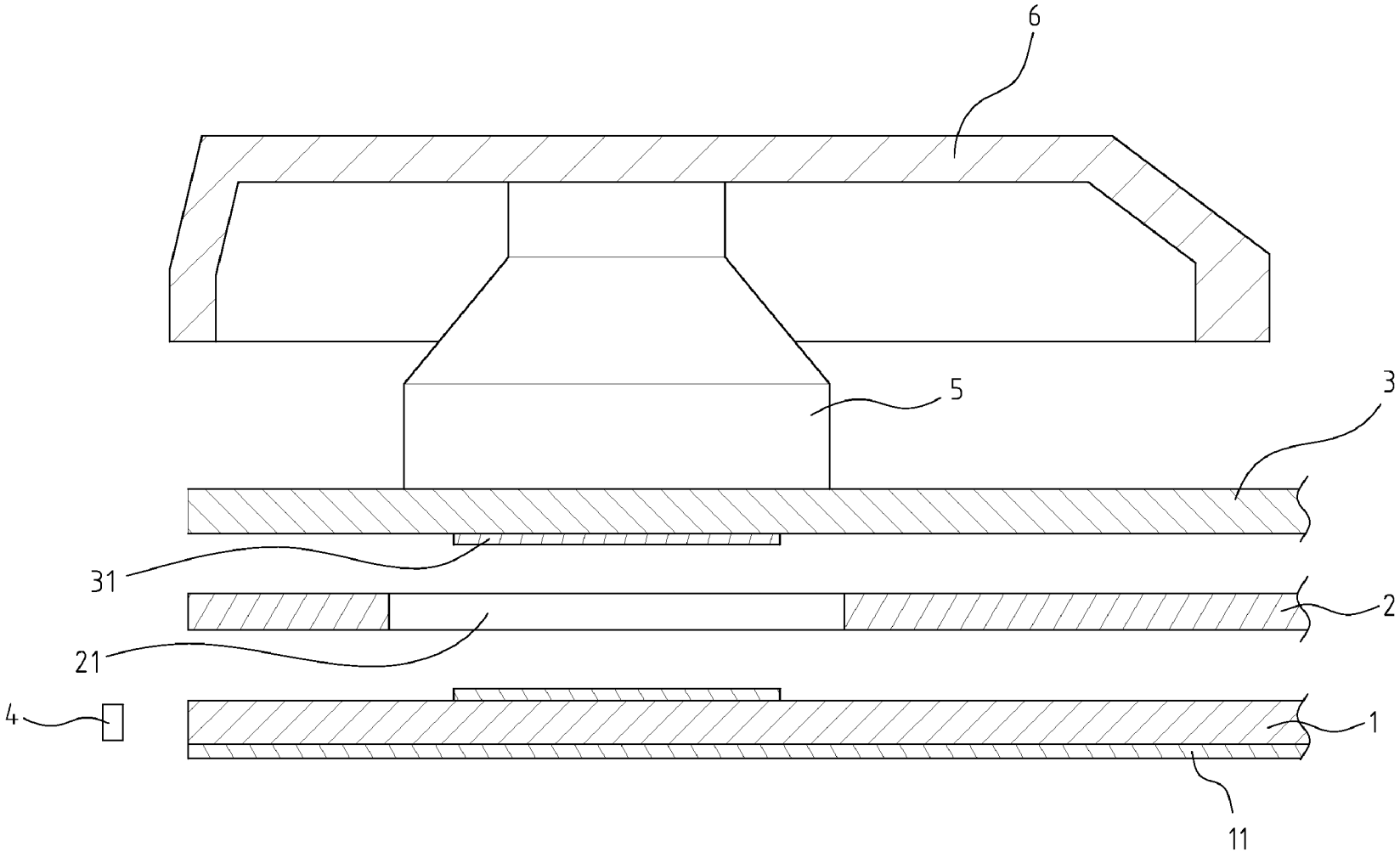
FIG. 1 is an exploded cross-sectional view of a key structure according to an embodiment of the present invention.

FIG. 1 is an exploded cross-sectional view of a key structure according to an embodiment of the present invention. Referring to FIG. 1, the present invention provides a key structure of a keyboard preferably including a light guide plate 1, an isolation sheet 2, a circuit board 3, an elastic member 5, and a key cap 6 sequentially disposed one on another in order. The light guide plate is made of an optical material having optical light guiding characteristics. In order to obtain a thinner backlight module, a circuit and a plurality of first electrical contacts 12 are distributed on a top surface of the light guide plate 1. An optical structure 11 is disposed at a bottom surface of the light guide plate. The optical structure 11 can be composed of a plurality of fine round protrusion or recess dots, or polygonal protrusion or recess dots, or the like. The optical structure 11 is adapted for reflecting a light transmitted in the light guide plate 1 and at the same time adaptively refracting the light so as to uniform and soften the light. The first electrical contacts 12 are distributed corresponding to positions of the key caps 6 of the keyboard, so that when the key cap 6 is pressed down, a corresponding one of the first electrical contacts 12 is electrically connected for output a control signal. A light source 4 is provided at a lateral side of the light guide plate 1. Preferably, the light source 4 emits a light along a direction perpendicular with a lateral side of the circuit board 3. In such a way, the light source 4 inputs the light into the light guide plate 1 for transmitting therein. The optical structure 11 upwardly reflects the light. According to an aspect of the embodiment, the light source 4 is an LED. The circuit board 3 is configured with a circuit for collaborating with the circuit of the light guide plate 1 for controlling the operation of the control signal. A plurality of second electrical contacts 31 is disposed at a bottom surface of the circuit board 3 positionally corresponding to the first electrical contacts 12.

The isolation sheet 2 is a member provided for isolating the light guide plate 1 and the circuit board 3. The provision of the isolation sheet 2 maintains the first electrical contact 12 is not electrically connected to the second electrical contact 31 when there is not an external force applied thereto. When an external force is applied to a key cap, the first electrical contact 12 is electrically connected to the second electrical contact 31, thus emitting a control signal corresponding to the key cap being pressed. The isolation sheet 2 is configured with a plurality of through holes 21 positionally corresponding to the first electrical contacts 12 and the second electrical contacts 31. The through holes 21 serve as connection passages for electrically connecting the first electrical contacts 12 and the second electrical contacts 31.

The isolation sheet 2 has a light reflective surface positioned facing the light guide plate 1. The light reflective surface may have a plurality of fine protrusion dots, or fine recess dots, or protrusion ribs, or recess slots thereon (not shown). The light reflective surface is adapted for reflecting the light outputted from the light guide plate 1 back to the light guide plate 1. Then, the light is reflected by the optical structure 11 to pass through the through holes 21, thus allowing more light outputting through the through holes 21, so as to improve the illumination of the key cap, and improve the light emitting efficiency.

In order to achieve an ideal light transmission upwardly, the circuit board 3 is made of a material having optimal light transmitting characteristic, e.g., a transparent plastic. The elastic member 5 is disposed on the circuit board 3, and the key caps 6 are assembled on the elastic member 5. The key caps 6 are preferably made of light transmissive material. Or alternatively, only the characters or symbols presented on the key caps are transparent.

Figure 2:
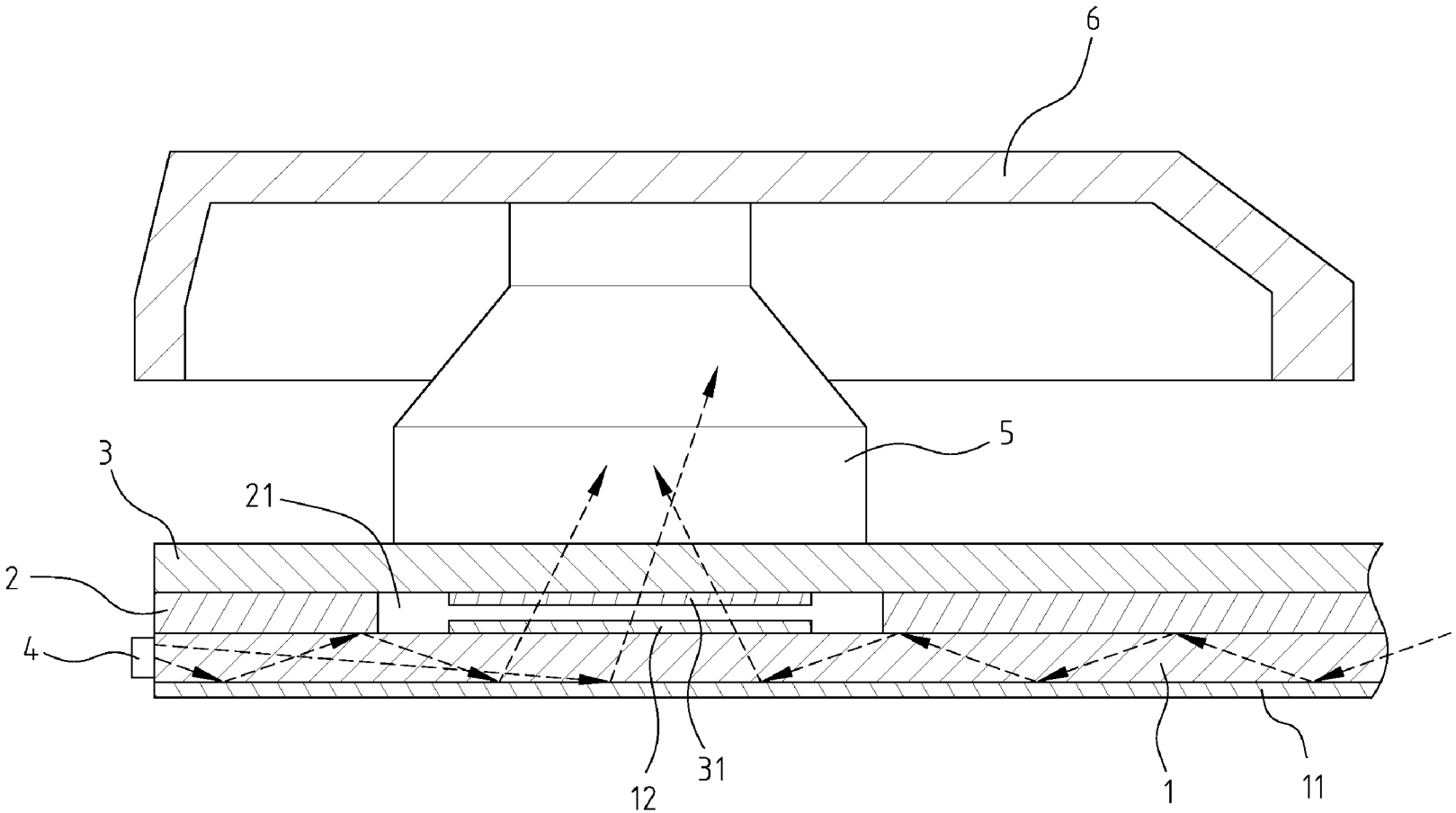
FIG. 2 is an enlarged view showing the key structure and the light transmission path thereof.
Figure 3:
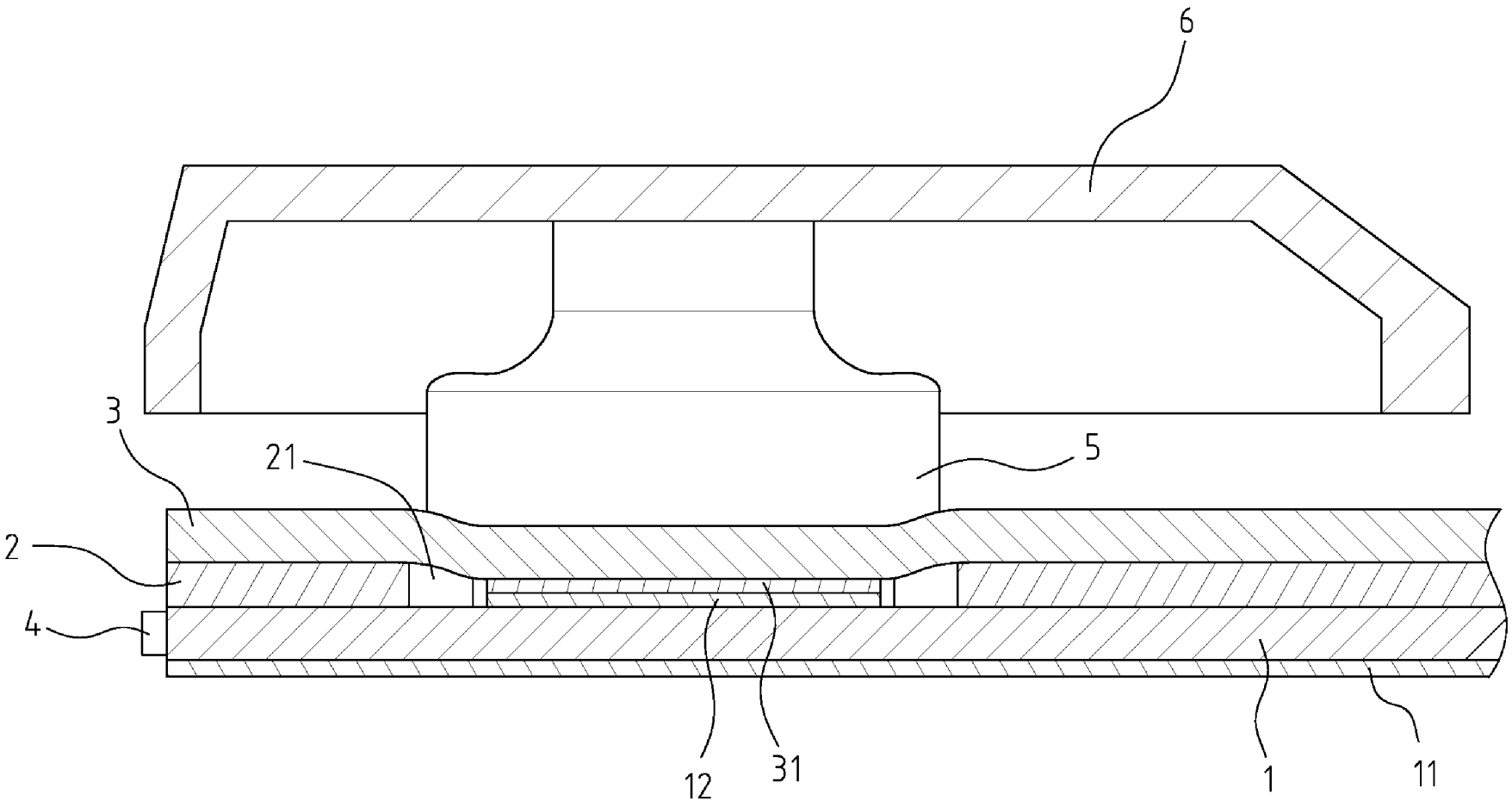
FIG. 3 is a schematic diagram illustrating the key structure, in which the key cap is pressed down and the first electrical contacts and the second electrical contacts get in electrical connection.

FIG. 2 is an enlarged view showing the key structure and the light transmission path thereof. When the key cap 6 is not pressed, the first electrical contact 12 and the second electrical contact 31 is isolated by the isolation sheet, thus remaining unconnected one from another. When the key cap 6 is pressed down, the elastic member 4 is also downwardly pressed, so as to downwardly push the circuit board 3. In this case, the second electrical contact 31 gets in electrical connection with the first electrical contact 12, as shown in FIG. 3, thus triggering the circuit to generate a control signal thereby. When the key cap 6 is released off, the elastic member 5 provides an elastic recovery force to return the key cap 6 back. Meanwhile, the first electrical contact 12 and the second electrical contact 31 are isolated one from another, and the electrical connection previously gotten therebetween is detached. When the light source 4 emits a light, the light is inputted into the light guide plate 1 and is transmitted therein. A part of the light is directly reflected by the optical structure 11 to pass through the through holes 21 of the isolation sheet 2 and the circuit board 3, so as to output from the key caps 6. Another part of the light is reflected back to the light guide plate 1 by the bottom surface of the isolation sheet 2, and is then reflected again by the optical structure 11 disposed at the bottom surface of the light guide plate 1 to pass through the through holes 21 of the isolation sheet 2 and the circuit board 3, so as to output from the key caps 6. In such a way, the key caps 6 achieve an optical visual effect.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. A key structure having an improved light emitting efficiency, comprising:

a light guide plate having a top surface and a bottom surface, wherein a circuit and a plurality of first electrical contacts are distributed on a top surface of the light guide plate, an optical structure is disposed at a bottom surface of the light guide plate, and a light source is provided at a lateral side of the light guide plate;

an isolation sheet, disposed on the light guide plate and configured with a plurality of through holes positionally corresponding to the first electrical contacts;

a circuit board, disposed on the isolation sheet, wherein a plurality of second electrical contacts are disposed at a bottom surface of the circuit board positionally corresponding to the through holes and the first electrical contacts;

an elastic member disposed on the circuit board; and a key cap disposed on the elastic member, wherein the light source emits a light into the light guide plate; the isolation sheet has a light reflective surface facing the light guide plate, and the light reflective surface is adapted for reflecting a light outputted from the light guide plate back to the light guide plate, and the light is then reflected by the optical structure to pass through the through holes and the circuit board, so as to output from the key cap.

2. The key structure according to claim 1, wherein the optical structure is a reflective film.

3. The key structure according to claim 1, wherein the optical structure is composed of a plurality of fine protrusion dots.

4. The key structure according to claim 1, wherein the optical structure is composed of a plurality of fine recess dots.

5. The key structure according to claim 1, wherein the light reflective surface of the isolation sheet has a plurality of fine protrusion dots thereon.

6. The key structure according to claim 1, wherein the light reflective surface of the isolation sheet has a plurality of fine recess dots thereon.

7. The key structure according to claim 1, wherein the light reflective surface of the isolation sheet has a plurality of protrusion ribs thereon.

8. The key structure according to claim 1, wherein the light reflective surface of the isolation sheet has a plurality of recess slots thereon.

* * * * *